US005490695A

United States Patent [19]

Shiue

[11] Patent Number: 5,490,695

[45] Date of Patent: Feb. 13, 1996

[54] DEAD BOLT ASSEMBLY FOR TUBULAR DOOR LOCKS

[75] Inventor: Jiang-Lin Shiue, Kaohsiung Hsien, Taiwan

[73] Assignee: Taiwan Fu Hsing Industrial Co., Ltd., Kaohsiung Hsien, Taiwan

[21] Appl. No.: 291,465

[22] Filed: Aug. 17, 1994

[51] Int. Cl.[6] ..... E05C 1/00

[52] U.S. Cl. ..... 292/1.5; 292/169

[58] Field of Search ..... 292/337, 1.5, 169, 292/DIG. 60, 169.11, 169.21

[56] References Cited

U.S. PATENT DOCUMENTS 5,354,109 10/1994 Lin ..... 292/1.5

*Primary Examiner*—Rodney M. Lindsey

*Attorney, Agent, or Firm*—Jacobson, Price, Holman & Stern

[57] ABSTRACT

A door lock includes a dead bolt slidably received in a lock case and having a pair of extensions extended outward beyond the lock case. A pair of plates are fixed to the lock case and each has an oblong hole. An actuating wheel is slidably engaged in the oblong holes and includes a pair of teeth for engaging with the extensions. A board is disposed between the plates and has two bulges for forcing the actuating wheel toward one of the plates so as to retain the actuating wheel in place. A resilient member has a throat portion for positioning the actuating wheel in either end of the oblong holes.

3 Claims, 4 Drawing Sheets

DEAD BOLT ASSEMBLY FOR TUBULAR DOOR LOCKS

BACKGROUND OF THE INVENTION 1. (a) Field of the Invention

The present invention relates to a dead bolt assembly, and more particularly to a dead bolt assembly for a tubular door lock.

2. (b) Description of the Prior Art

Various kinds of tubular door locks have been developed and widely used, some of which are disclosed in the following U.S. Patents: U.S. Pat. No. 4,804,216 to Marotto, filed Feb. 1, 1988, entitled "CONVERTIBLE BACKSET LATCH MECHANISM"; U.S. Pat. No. 4,890,871 to Lin, filed Nov. 17, 1988, entitled "TUBULAR DOOR LOCK WITH AN ADJUSTABLE DEVICE FOR SETTING THE DEAD BOLT"; Re. 34,240 of U.S. Pat. No. 4,890,871, to Lin, filed Apr. 17, 1991. U.S. Pat. No. 5,102,175 to Wu et al., filed Nov. 17, 1988, entitled "DEADBOLT ASSEMBLY FOR CYLINDER LOCK"; and U.S. Pat. No. 5,257,838 to Lin, filed Nov. 24, 1992, entitled "DEAD BOLT ASSEMBLY FOR TUBULAR DOOR LOCKS". In these patents, a number of complicated retaining means are provided for retaining the actuating wheel in place.

The present invention has arisen to mitigate and/or obviate the afore-described disadvantages of the conventional tubular door locks.

SUMMARY OF THE INVENTION

The primary objective of the present invention is to provide a dead bolt assembly for a tubular door lock which has a simplified retaining means for retaining the actuating wheel in place.

In accordance with one aspect of the present invention, there is provided a dead bolt assembly comprising a dead bolt slidably received in a lock case and having a pair of extensions extended outward beyond the lock case, each of the extensions including a pair of protrusions extended therefrom, a pair of plates fixed to the lock case and each including an oblong hole formed therein, each of the oblong holes including two end portions, an actuating wheel slidably engaged in the oblong holes of the plates and slidable between the end portions of the oblong holes and slidable between the extensions of the dead bolt, the actuating wheel including a pair of teeth for engaging with the protrusions of the extensions when the actuating wheel is rotated, and a board disposed between the plates and including an orifice formed therein for engaging with the actuating wheel, the board including bulge means for engaging with the actuating wheel and for forcing the actuating wheel toward one of the plates so as to retain the actuating wheel in place.

A resilient member is further secured to one of the plates. The resilient member includes a throat portion located intermediate of the oblong holes for engaging with the actuating wheel and for positioning the actuating wheel in either of the end portions such that the actuating wheel can further be stably retained in place.

The actuating wheel includes two halves each having a hub slidably engaged in the oblong holes of the respective plates, a first half of the two halves includes at least one depression formed therein, and a second half of the two halves includes at least one projection formed thereon for engaging with the depression so as to secure the two halves together such that the two halves rotate in concert.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
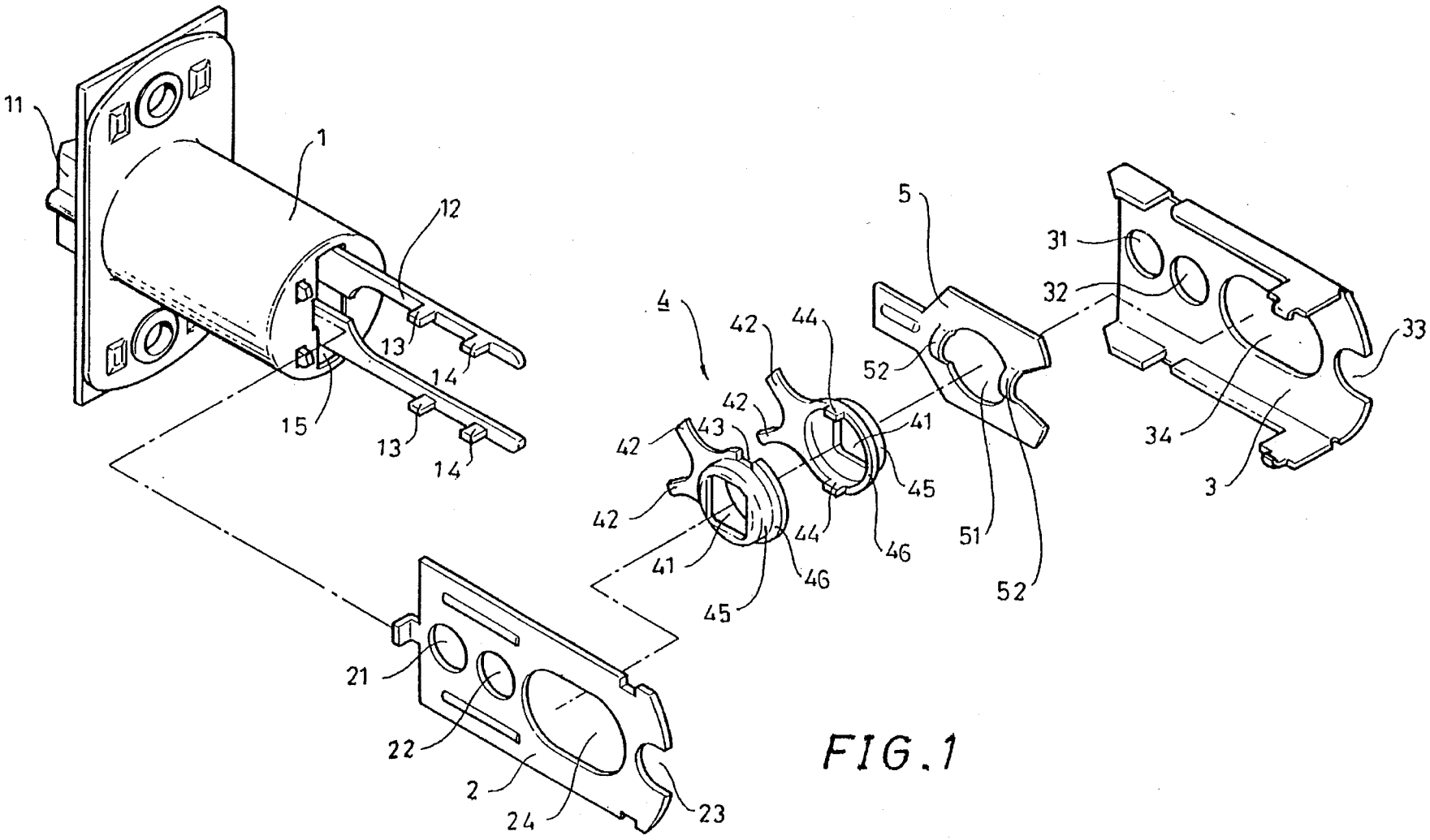
FIG. 1 is an exploded view of a dead bolt assembly for a tubular door lock in accordance with the present invention.
Figure 2:
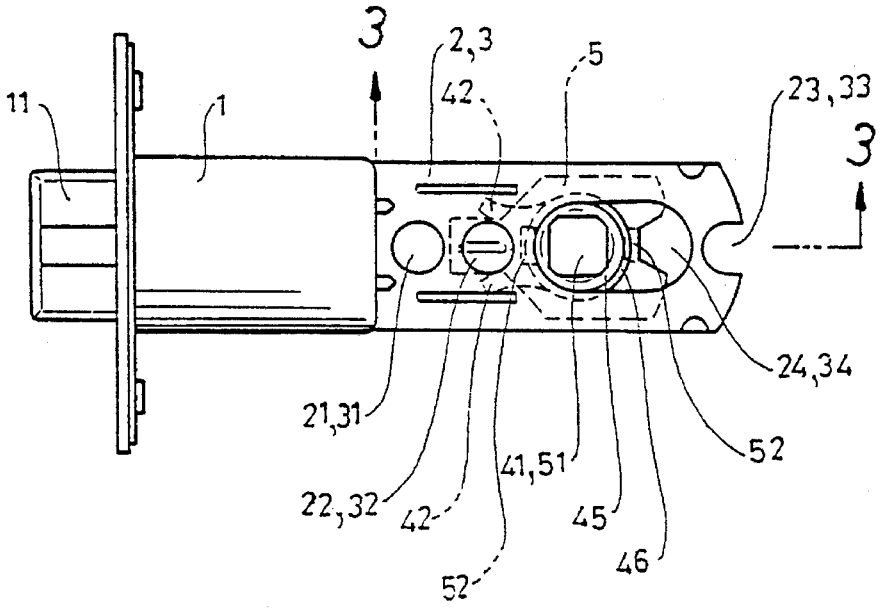
FIG. 2 is a plane view of the dead bolt assembly.
Figure 3:
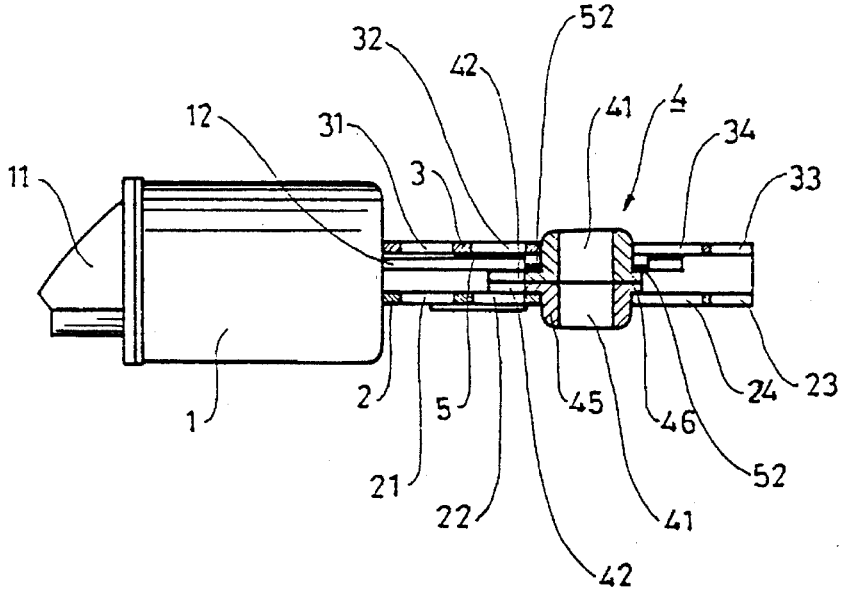
FIG. 3 is a cross sectional view taken along lines 3—3 of FIG. 2.

Referring to the drawings and initially to FIGS. 1 to 3, a dead bolt assembly for a tubular door lock in accordance with the present invention comprises generally a lock case 1, a dead bolt 11 accommodated within the lock case 1, a pair of plates 2, 3 coupled to the lock case 1, and an actuating wheel 4 engageable with the dead bolt 11 for operating the dead bolt 11.

The dead bolt 11 includes a pair of extensions 12 extended outward through an opening 15 of the lock case 1. Each of the extensions 12 includes a pair of protrusions 13, 14 extended therefrom. The actuating wheel 4 includes two halves engageable with each other and each having a square hole 41 formed in the center thereof for insertion of the square shaft of the door lock (not shown) so that the actuating wheel 4 can be rotated. The two halves each includes a pair of teeth 42 for engaging with the protrusions 13, 14 of the extensions 12 when the actuating wheel 4 is rotated. One of the two halves includes a pair of depressions 43 formed therein for engaging with two corresponding projections 44 formed in the other half such that the two halves rotate in concert when the projections 44 are engaged in the depressions 43. The two halves each includes an annular flange 46 and a hub 45 formed thereon.

The plates 2, 3 are fixed to the lock case 1 and each includes two openings 21, 22, 31, 32 and a notch 23, 33 formed therein for fixing the plates 2, 3 to the door (not shown) such that the plates 2, 3 and the lock case 1 are fixed within the door. The plates 2, 3 each further includes an oblong hole 24, 34 formed therein for slidably engaging with the hubs 45 of the actuating wheel 4. A board 5 is disposed between the actuating wheel 4 and the plate 3 and includes an orifice 51 formed therein for engaging with the hub 45 of the actuating wheel 4, and includes two bulges 52 formed thereon for engaging with the annular flange 46 so as to force the actuating wheel 4 toward the plate 2.

Figure 4:
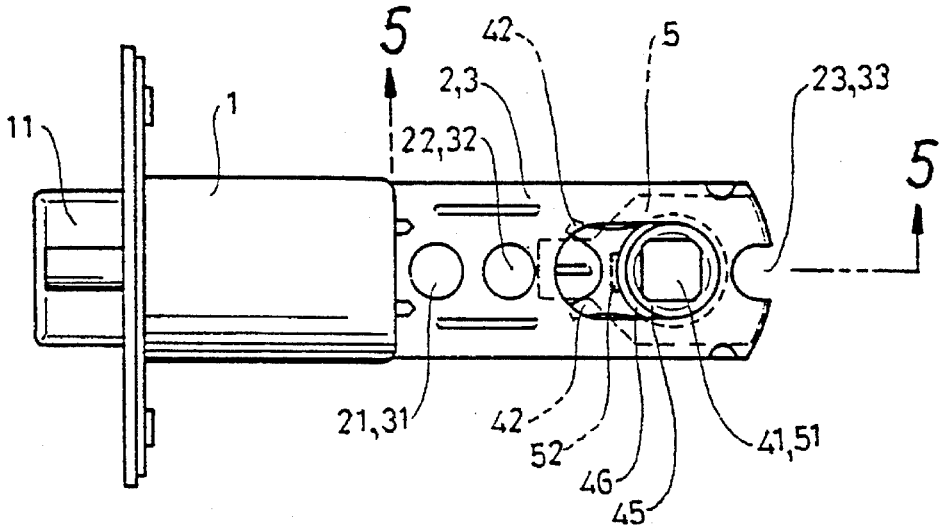
FIG. 4 is a plane view similar to FIG. 2, illustrating the operation of the dead bolt assembly.
Figure 5:
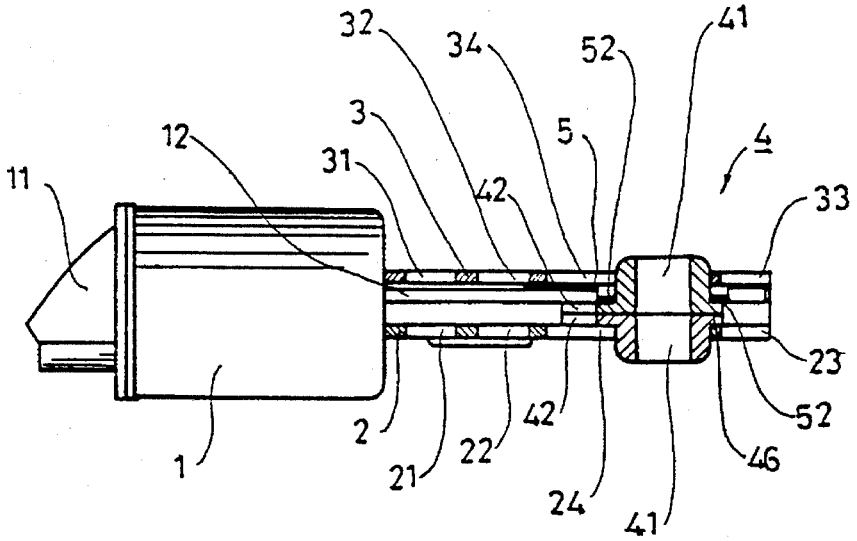
FIG. 5 is a cross sectional view taken along lines 5—5 of FIG. 4.

In operation, as shown in FIGS. 2 and 3, when the actuating wheel 4 is moved toward one end of the oblong holes 24, 34 closer to the lock case 1, the bulges 52 of the board 5 may force the actuating wheel 4 toward the plate 2 so as to retain the actuating wheel 4 in place. As shown in FIGS. 4 and 5, when the actuating wheel 4 is moved toward the other end of the oblong holes 24, 34 distal to the lock case 1, the bulges 52 of the board 5 may also force the actuating wheel 4 toward the plate 2 so as to retain the actuating wheel 4 in place.

Figure 6:
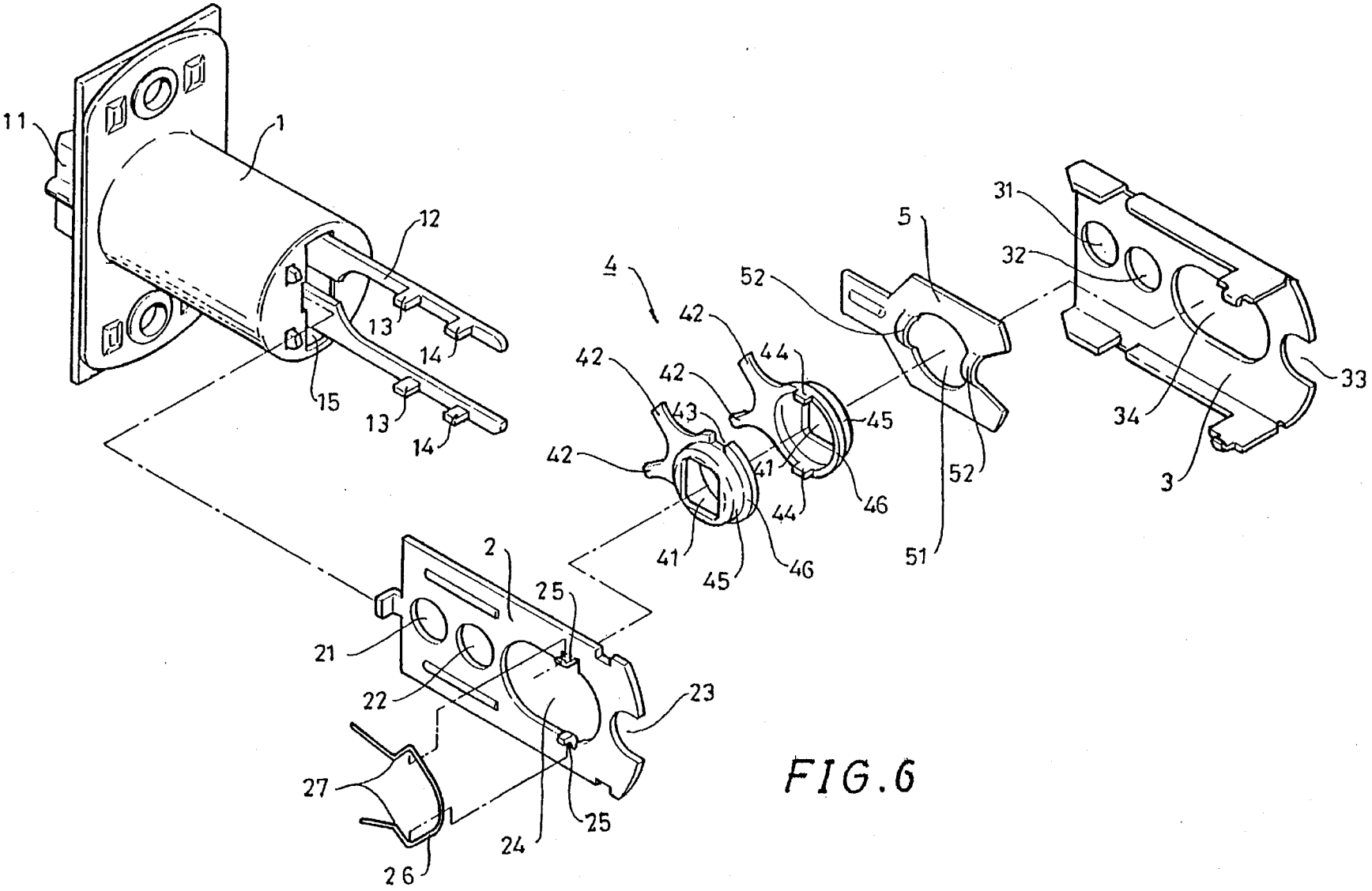
FIG. 6 is an exploded view showing another application of the present invention.

Referring next to FIG. 6, in addition to the board 5, a resilient member 26 is provided and secured to two lugs 25 of the plate 2. The resilient member 26 includes two throat portions 27 located at the middle portion of the oblong hole 24 for engaging with the actuating wheel 4 so as to further position the actuating wheel 4 in either end of the oblong hole 24.

It is to be noted that the oblong holes 24, 34 are provided such that actuating wheel 4 may slide to either of the end portions of the oblong holes 24, 34. This is particular appreciated for assembling the door locks having different sizes. However, the actuating wheel 4 is engaged on the square shaft of the door lock and can be stably retained in place by the square shaft, such that, without the resilient member 26 and the board 5, the actuating wheel 4 can also be positioned. The resilient member 26 and the board 5 are provided for further stably positioning the actuating wheel 4.

Accordingly, the dead bolt assembly for a tubular door lock in accordance with the present invention has a simplified retaining means for retaining the actuating wheel in place.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A dead bolt assembly comprising:

a lock case, a dead bolt slidably received in said lock case and including a pair of extensions extended outward beyond said lock case, each of said extensions including a pair of protrusions extended therefrom, a pair of plates fixed to said lock case and each including an oblong hole formed therein, each of said oblong holes including two end portions, an actuating wheel slidably engaged in said oblong holes of said plates and slidable between said end portions of said oblong holes and slidable between said extensions of said dead bolt, said actuating wheel including a pair of teeth for engaging with said protrusions of said extensions when said actuating wheel is rotated, and a board disposed between said plates and including an orifice formed therein for engaging with said actuating wheel, said board including bulge means for engaging with said actuating wheel and for forcing said actuating wheel toward one of said plates so as to retain said actuating wheel in place.

2. A dead bolt assembly according to claim 1 further comprising a resilient member secured to one of said plates, said resilient member including a throat portion located intermediate of said oblong holes for positioning said actuating wheel in either of said end portions.

3. A dead bolt assembly according to claim 1, wherein said actuating wheel includes two halves each having a hub slidably engaged in said oblong holes of the respective plates, a first half of said two halves includes at least one depression formed therein, and a second half of said two halves includes at least one projection formed thereon for engaging with said depression so as to secure said two halves together.

* * * * *